US005533223A

United States Patent [19]

Ho

[11] Patent Number: 5,533,223

[45] Date of Patent: Jul. 9, 1996

[54] CLEANING SWEEPER HAVING AN ADHESIVE ROLLER

[76] Inventor: Huang C. Ho, P.O. Box 453, Taichung, Taiwan

[21] Appl. No.: 436,092

[22] Filed: May 8, 1995

[51] Int. Cl.[6] ..... A47L 25/00

[52] U.S. Cl. ..... 15/104.002; 15/230.11; 206/447; 206/207; 206/320; 492/13; 83/922

[58] Field of Search ..... 15/104.002, 230.11; 492/13, 14; 206/447, 207, 320; 83/922

[56] References Cited

U.S. PATENT DOCUMENTS

| | | | |
|---|---|---|---|
| 3,148,398 | 9/1964 | Thomas, Jr. | 15/104.002 |
| 3,363,276 | 1/1968 | Thomas, Jr. | 15/104.002 |
| 3,383,063 | 5/1968 | Balaban | 15/104.002 |
| 3,398,418 | 8/1968 | Bogner et al. | 15/104.002 |

FOREIGN PATENT DOCUMENTS

| | | | |
|---|---|---|---|
| 158600 | 4/1954 | Australia | 15/104.002 |
| 489214 | 12/1967 | Switzerland | 15/104.002 |
| 2233884 | 1/1991 | United Kingdom | 15/104.002 |
| 2277252 | 10/1994 | United Kingdom | 15/104.002 |
| 1734 | 5/1983 | WIPO | 15/104.002 |

*Primary Examiner*—Gary K. Graham

[57] ABSTRACT

A cleaning sweeper comprises an adhesive paper roll, a reel support frame, a dual-directional paper cutter, and a handle. The adhesive paper roll is wound on a reel fastened pivotally with the reel support frame. As the adhesive paper roll is moved on the surface of a carpet or floor, the dirt on the surface of the carpet or floor is attached to the adhesive paper roll, which becomes soiled gradually. The soiled paper is cut off with a paper cutter mounted pivotally in the reel support frame. The paper cutter is capable of preventing the adhesive surface of the adhesive paper roll from making contact with the surface of a floor or wall when the cleaning sweeper is not in use temporarily and is laid on the floor or hung on the wall.

6 Claims, 9 Drawing Sheets

CLEANING SWEEPER HAVING AN ADHESIVE ROLLER

FIELD OF THE INVENTION

The present invention relates generally to a cleaning device, and more particularly to a sweeper for cleaning carpet, floor and so forth.

BACKGROUND OF THE INVENTION

The conventional sweeper for cleaning carpet or floor is generally composed of a handle having at the bottom thereof a support frame to which a cleaning roller is fastened pivotally. As the cleaning roller is moved on the surface of a carpet or floor, the dirt on the carpet or floor is attached to the surface of the roller.

Such a conventional cleaning sweeper as described above is defective in design in that the cleaning roller must be dipped occasionally into water for washing the dirt off the surface of the roller, thereby resulting in gradual reduction in adhesiveness of the surface of the cleaning roller, and thereby undermining the cleaning effect of the cleaning roller. In a way, the conventional cleaning sweeper described above is not different from a mop having a mophead which must be washed with water. Furthermore, the cleaning roller of the conventional cleaning sweeper described above is so sticky that it can not be kept or handled conveniently.

SUMMARY OF THE INVENTION

It is therefore the primary objective of the present invention to provide a cleaning sweeper with an adhesive paper roll wound on a reel which is fastened pivotally with a reel support frame of the sweeper. As the adhesive paper roll is moved on the surface of a carpet or floor, the dirt on the surface of the carpet or floor is attached to the adhesive paper roll, which becomes soiled gradually. The soiled paper is cut off with a cutter mounted on the reel support frame of the sweeper.

It is another objective of the present invention to provide a cleaning sweeper with a storage box for keeping the adhesive paper roll when the sweeper is not in use. The adhesive paper roll is held in the storage box such that the adhesive surface of the adhesive paper roll is not in contact with any surface of the storage box.

It is still another objective of the present invention to provide a cleaning sweeper with a dual-directional paper cutter capable of preventing the adhesive surface of the adhesive paper roll from making contact with the floor surface when the cleaning sweeper is not in use temporarily and is laid on the floor. The dual-directional paper cutter is also capable of preventing the adhesive surface of the adhesive paper roll from making contact with the surface of a wall on which the cleaning sweeper is hung.

The foregoing objectives, features, functions and advantages of the present invention will be more readily understood upon a thoughtful deliberation of the following detailed description of the present invention in conjunction with the accompanying drawings.

DETAILED DESCRIPTION OF THE INVENTION

Figure 1:
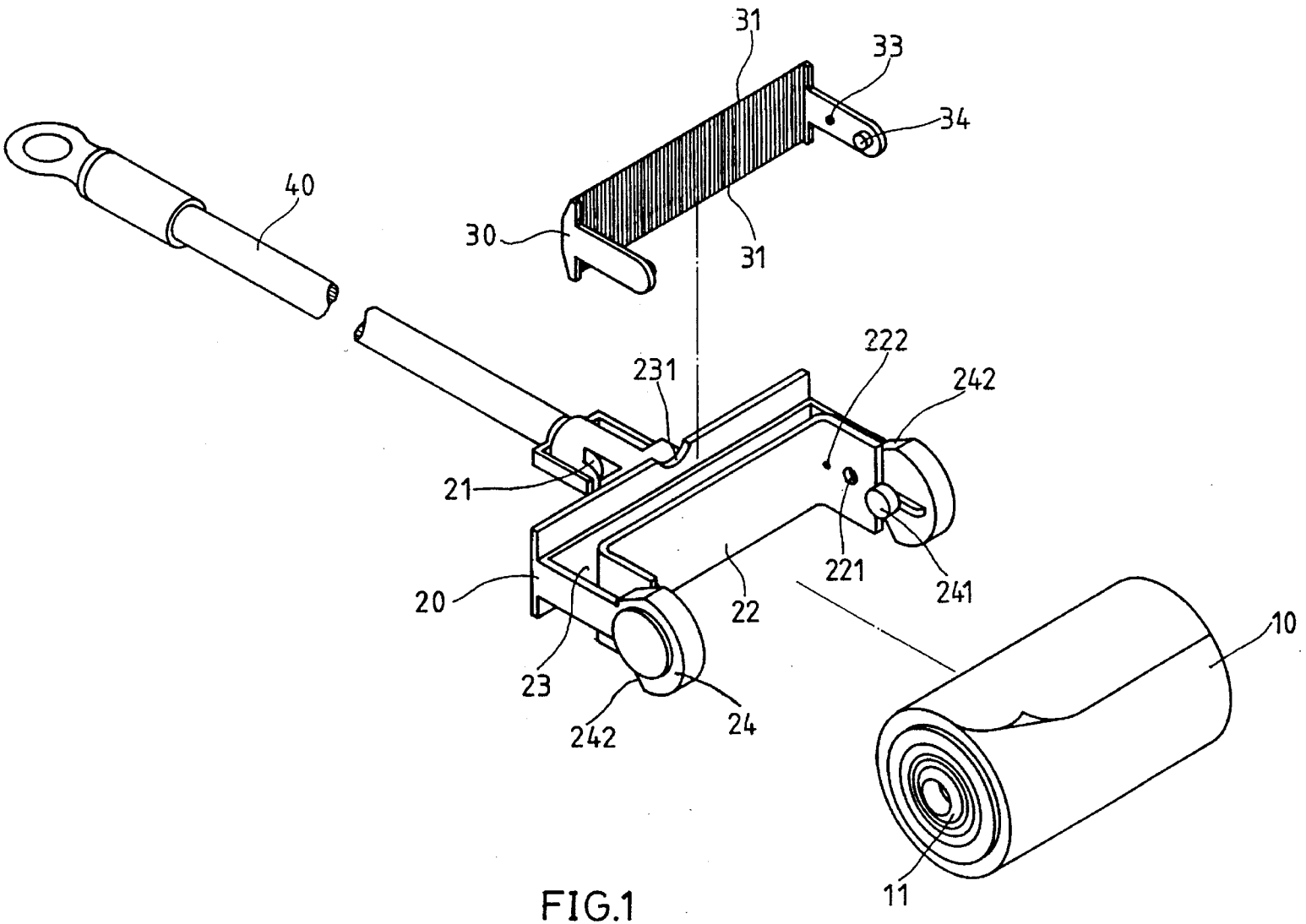
FIG. 1 shows an exploded view of the present invention.
Figure 2:
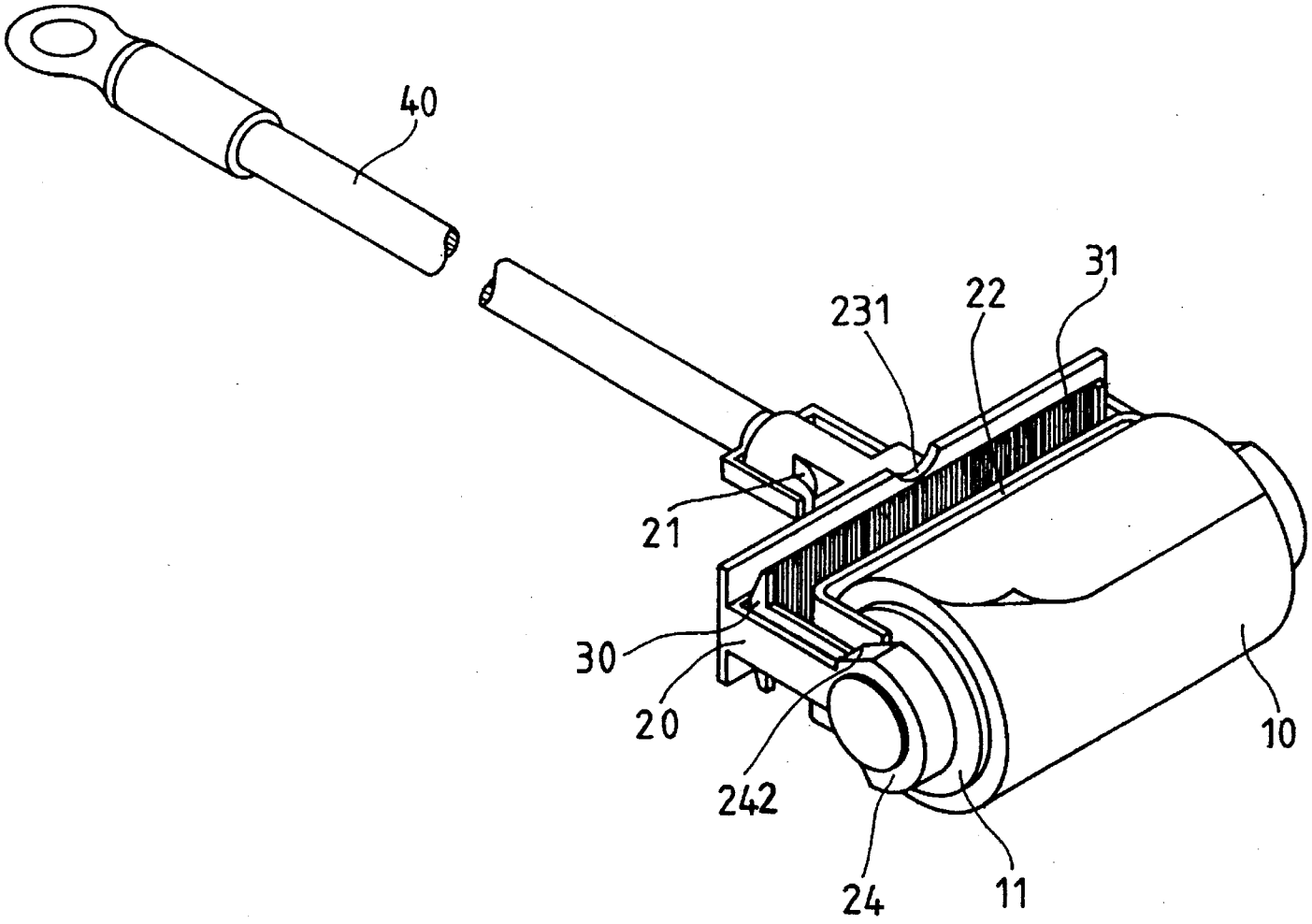
FIG. 2 shows a perspective view of the present invention in combination.

As shown in FIGS. 1 and 2, a cleaning sweeper embodied in the present invention comprises mainly an adhesive paper roll 10, a reel support frame 20, a dual-directional paper cutter 30, a handle 40 and a storage box 50.

The adhesive paper roll 10 is treated on upper side thereof with a dust-attaching adhesive substance and on underside thereof with a releasing agent and is wound on a reel 11 which is fastened pivotally at both ends thereof with the reel support frame 20 having a cutter receiving space 23 in which the dual-directional paper cutter 30 is mounted movably in such a manner that the paper cutter 30 is opposite in location to the adhesive paper roll 10.

The reel support frame 20 is of a U-shaped construction and is provided centrally on the outer side of the crown portion of the U-shaped support frame 20 with a coupling portion 21 engageable with a pivoting portion (not shown in the drawings) located in the lower end of the handle 40. The crown portion of the U-shaped support frame 20 is provided respectively and centrally in both longitudinal fringes thereof with an arcuate recess 231. Located between the inner side of the crown portion of the U-shaped support frame 20 and the adhesive paper roll 10 is a baffle 22 of a U-shaped construction. The baffle 22 is provided respectively in both leg portions of the U-shaped baffle 22 with a retaining hole 221 and a locating hole 222. The U-shaped support frame 20 is provided respectively at the end of the both leg portions thereof with a protective block 24 of a circular construction. The protective block 24 is provided with a pivoting block 241 engageable with one end of the reel 11 and located under the retaining hole 221. The protective block 24 is further provided with a stopping edge 242 facing the cutter receiving space 23.

The dual-directional paper cutter 30 is of a U-shaped construction and is mounted in the cutter receiving space 23. The U-shaped paper cutter 30 is provided obliquely on the inner side of the crown portion thereof with a cutting edge 31 facing the adhesive paper roll 10 and is further provided respectively at the free end of the leg portions thereof with a protuberance 34 engageable with the retaining hole 221 of the baffle 22, and a locating projection 33 engageable with the locating hole 222 of the baffle 22.

As shown in FIG.2, the dual-directional paper cutter 30 is mounted movably such that both protuberances 34 of the paper cutter 30 are engaged with the two retaining holes 221 of the baffle 22, and that the crown portion of the U-shaped paper cutter 30 is received in the cutter receiving space 23 and is shielded by the baffle 22. The adhesive paper roll 10 is mounted on the reel 11 which is fastened pivotally at both ends thereof with two pivoting blocks 241. As a result, the adhesive paper roll 10 can be turned on the reel 11 which is rotatably fastened at both ends thereof with the pivoting blocks 241 of the protective blocks 24 of the reel support frame 20.

Figure 3:
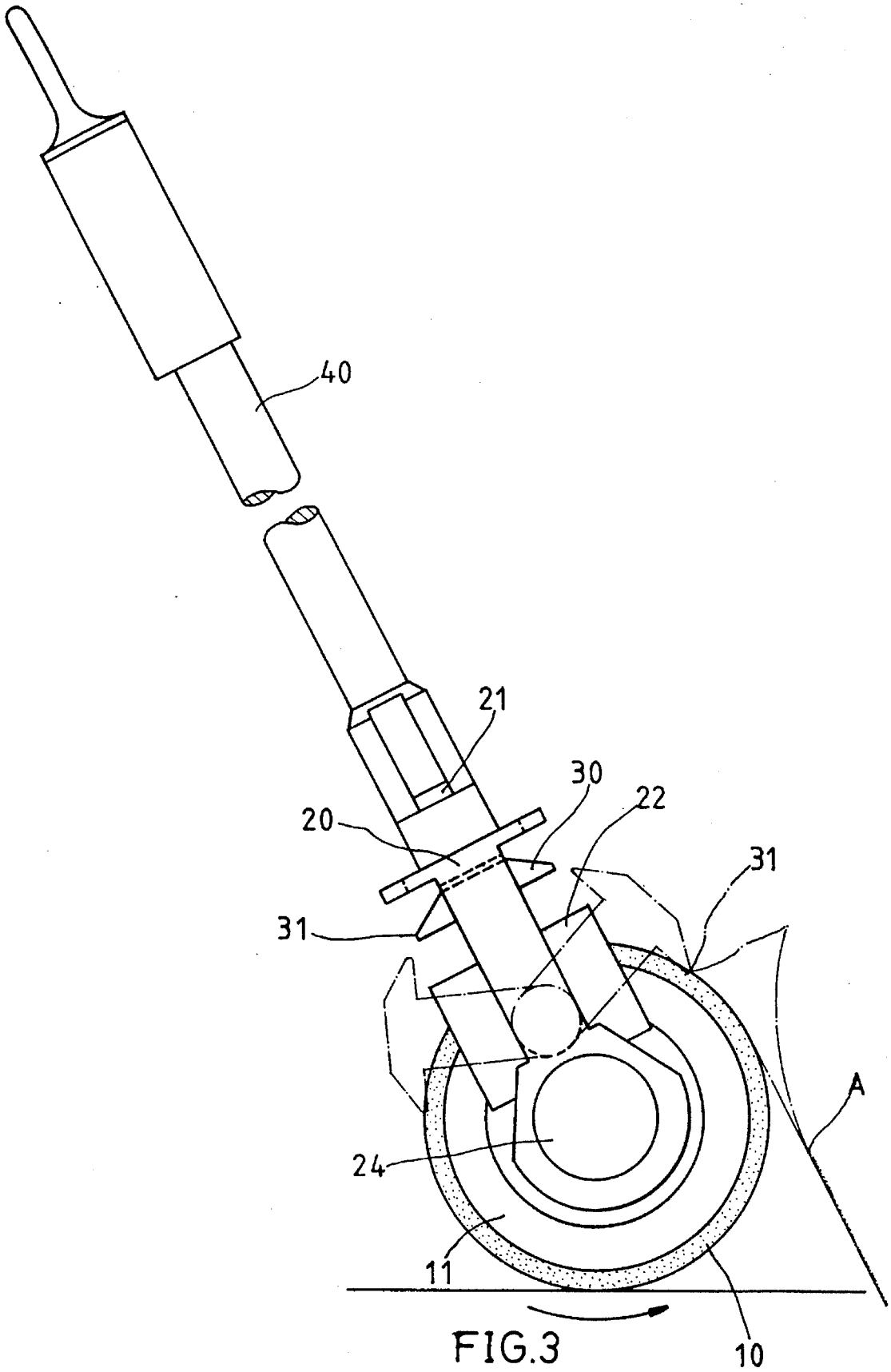
FIG. 3 shows a side elevational view of the present invention at work.
Figure 4:
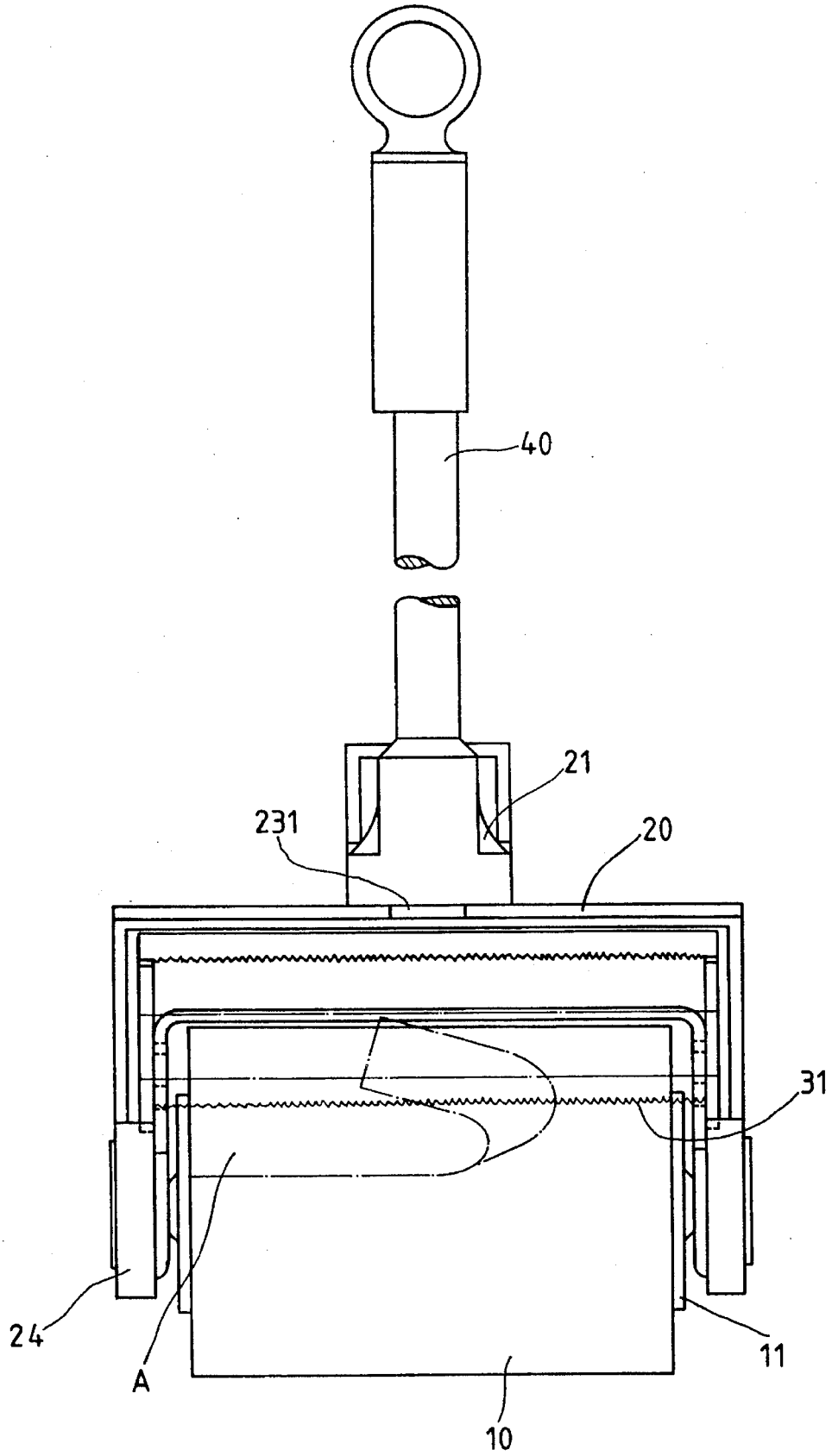
FIG. 4 is a schematic view illustrating the dual-directional paper cutter at work according to the present invention.

In operation, the cleaning sweeper of the present invention is rolled on the surface of a carpet or floor by a person with his or her hand holding the handle 41. As the adhesive paper roll 10 is turned on the reel 11, the dirt on the surface of the carpet or floor is picked up by the adhesive surface of the paper roll 10, as illustrated in FIGS. 3 and 4. When the adhesive surface of the paper roll 10 is so soiled that is must be removed, the paper roll 10 is rotated to rest at an appropriate position such that the soiled paper can be cut off by the dual-directional paper cutter 30. Thereafter, with the protuberances 34 serving as shafts, the paper cutter 30 is caused to move out of the cutter receiving space 23. The paper cutter 30 is then rotated in the direction which is dependent on the direction in which the paper roll 10 faces. As the paper cutter 30 is properly rotated such that the cutting edge 31 of the paper cutter 30 is rested against the boundary between the soiled paper and the clean fresh paper of the paper roll 10, the paper cutter 30 is exerted on by a pressure to permit the soiled portion, which is designated by A in FIG. 4, of the paper roll 10 to be cut off by the cutting edge 31 of the paper cutter 30. The stopping edges 242 of the two protective blocks 24 are intended to prevent the paper cutter 30 from turning after the soiled paper is cut off by the paper cutter 30. As the original paper roll 10 is exhausted, the cleaning sweeper of the present invention is provided with a fresh paper roll 10 mounted on a reel 11.

Figure 5:
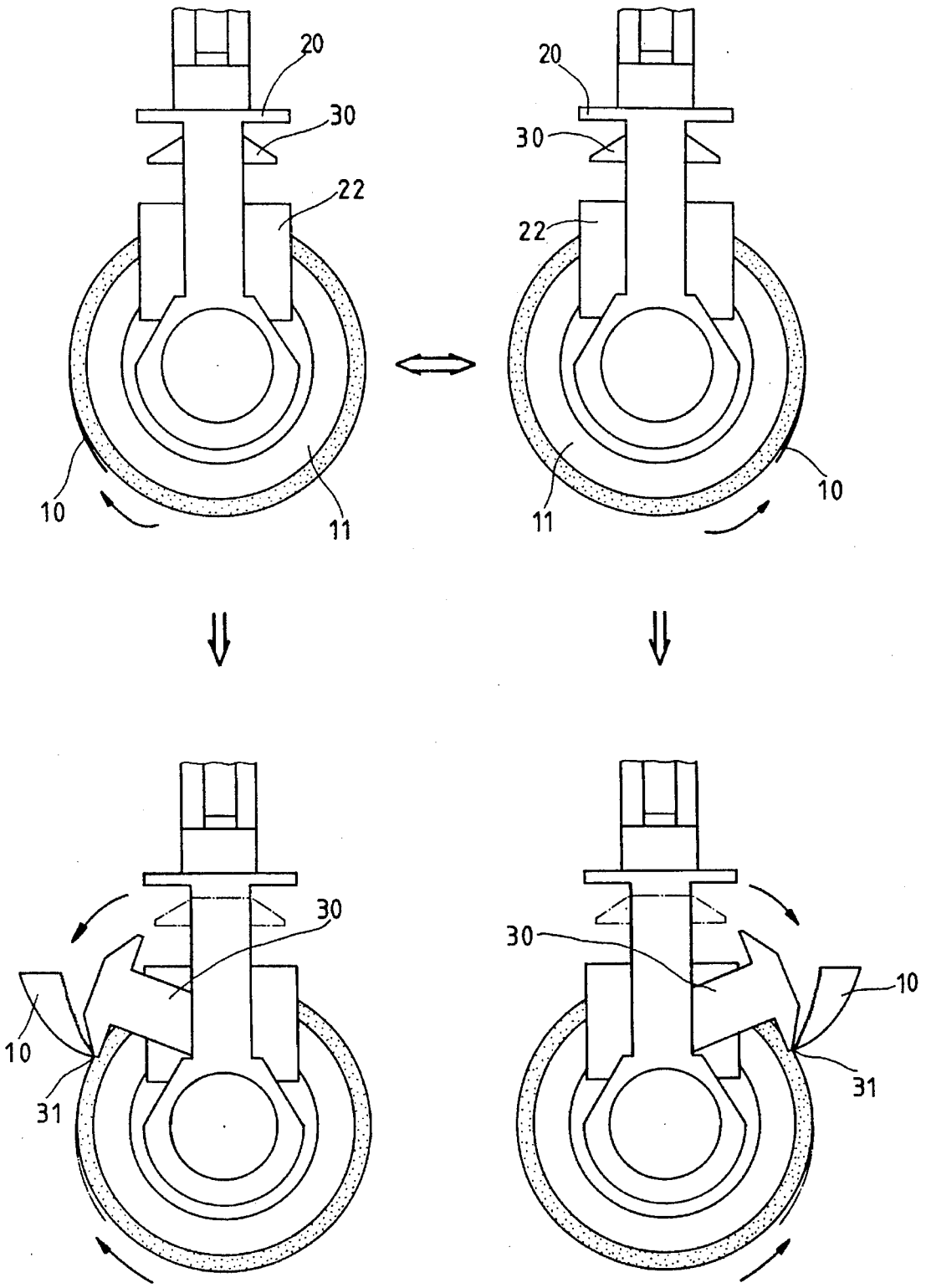
FIG. 5 includes four schematic views illustrating the ways that the dual-directional paper cutter of the present invention overcomes the situation in which the adhesive paper roll mounted on the reel may face different directions.

As illustrated in FIG. 5, the paper cutter 30 of the present invention can be turned in two directions such that the cutting edge 31 of the paper cutter 30 is located over the paper roll 10. As a result, the work of providing the cleaning sweeper of the present invention with a fresh paper roll 10 can be done without regard to the direction in which the paper roll 10 faces.

Figure 6:
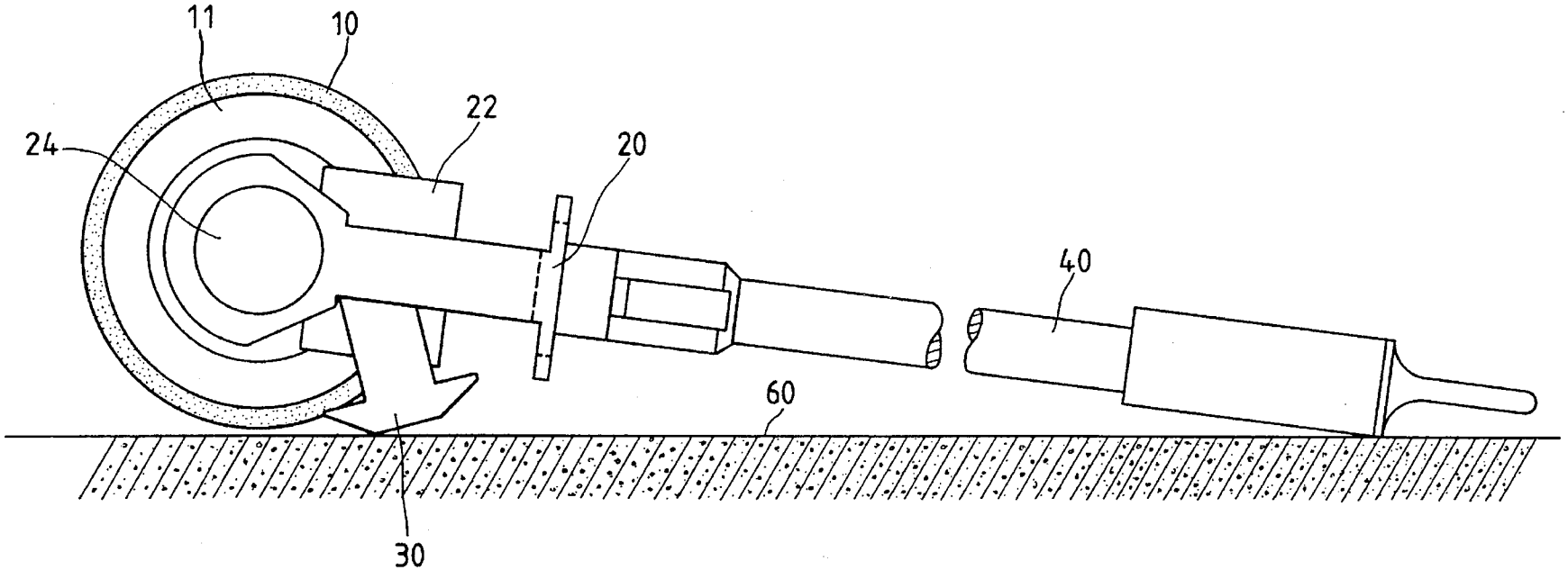
FIG. 6 is a schematic view showing that the cleaning sweeper of the present invention is laid on the floor.

As shown in FIG. 6, the cleaning sweeper of the present invention can be laid on a floor without causing the adhesive surface of the paper roll 10 to make contact with a horizontal surface 60 of the floor when the cleaning sweeper is not in use temporarily, thanks to the cutting edge 31 of the paper cutter 30 which serves to uphold the paper roll 10 so as to prevent the paper roll 10 from making contact with the horizontal surface 60 of the floor.

Figure 7:
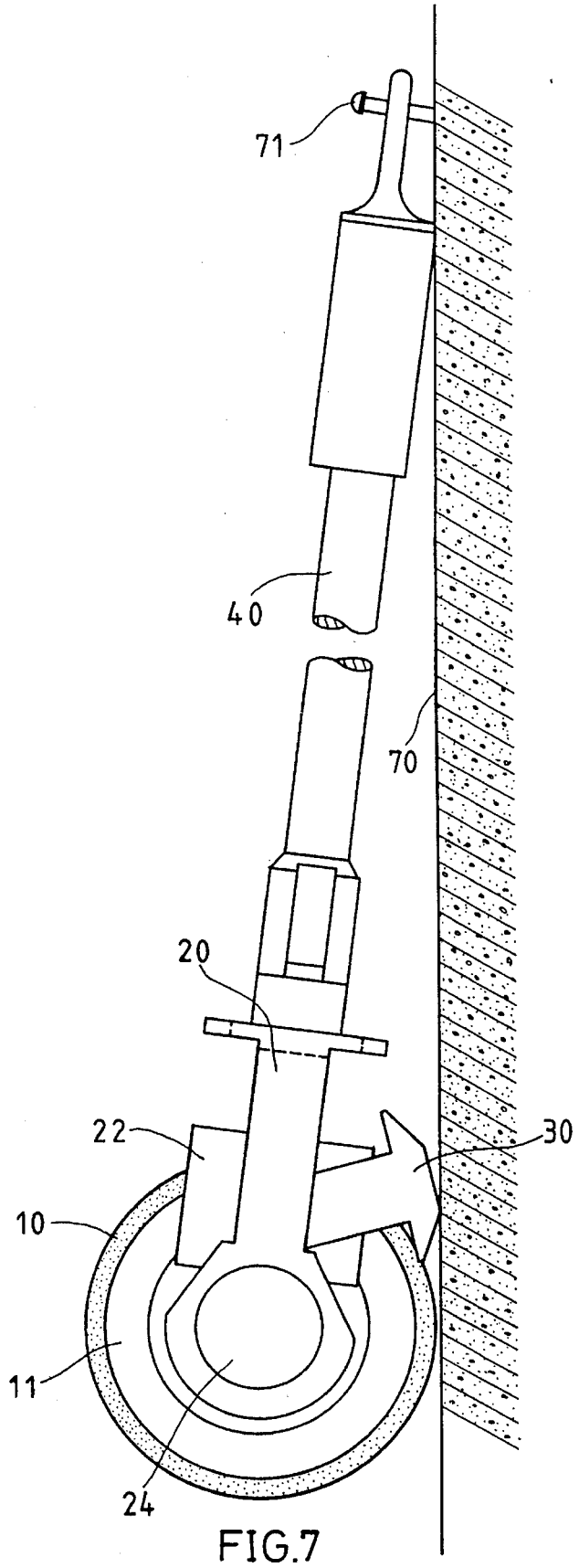
FIG. 7 is a schematic view showing that the cleaning sweeper of the present invention is hung on a wall.

As shown in FIG.7, the cleaning sweeper of the present invention can be hung with a nail 71 which is fastened onto a wall 70, without causing the paper roll 10 to make contact with the surface of the wall 70. The paper roll 10 is upheld by the cutting edge 31 of the paper cutter 30 such that the paper roll 10 is kept away from the surface of the wall 70.

Figure 8:
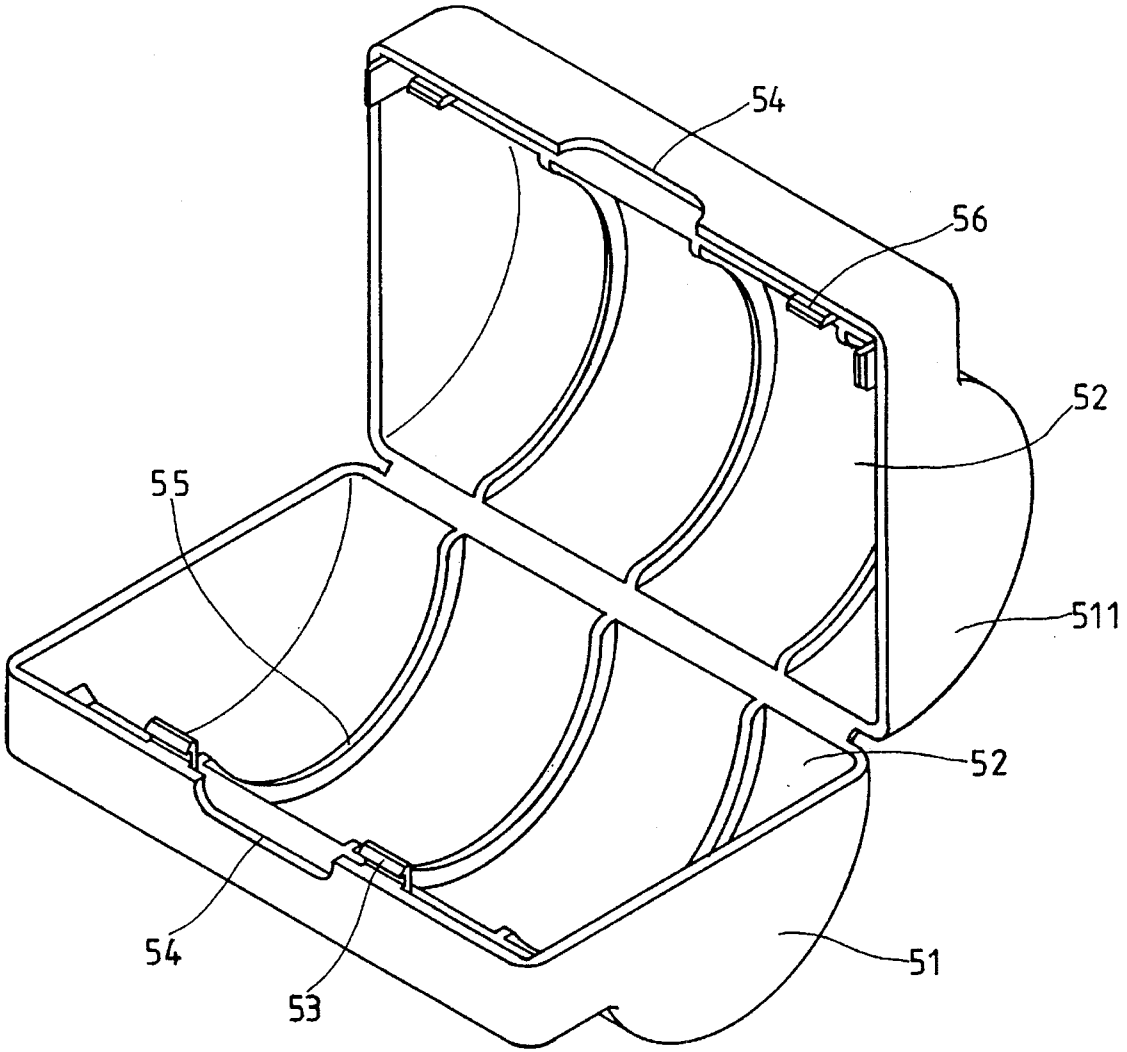
FIG. 8 shows a perspective view of the storage box of the present invention.
Figure 9:
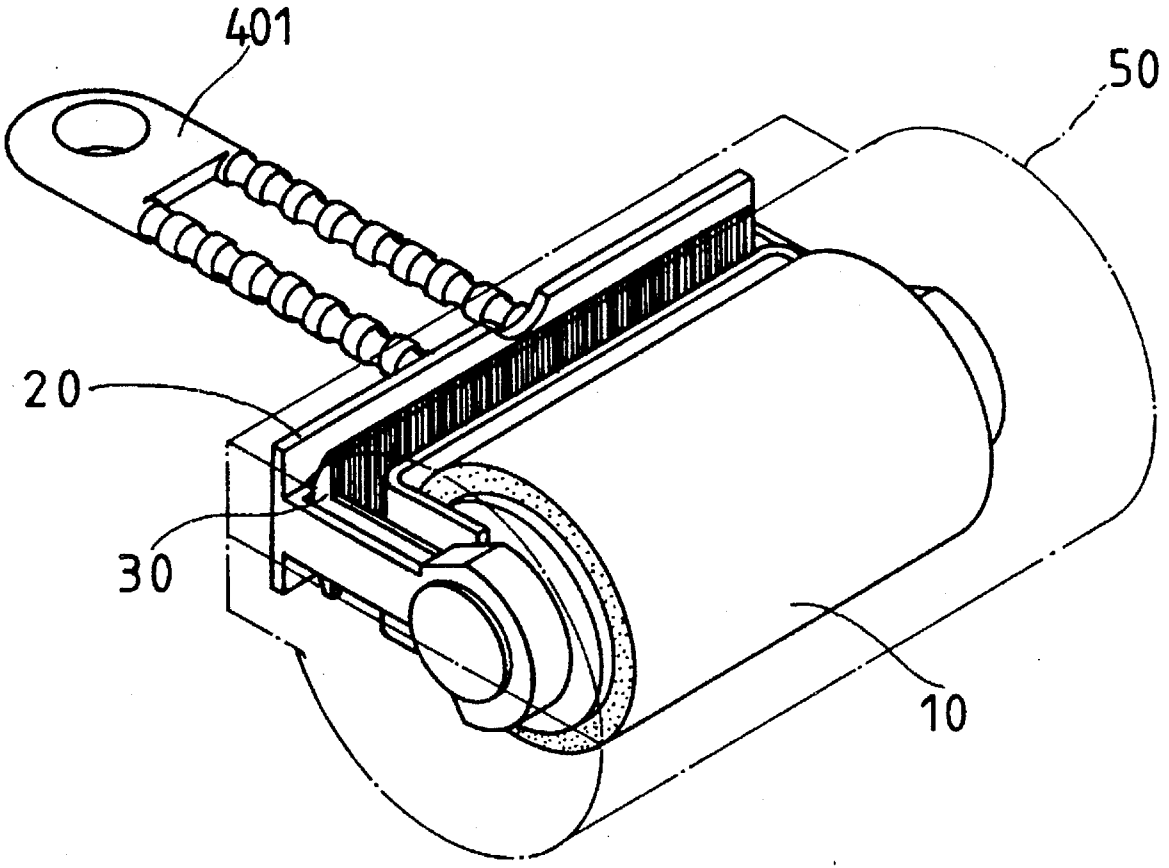
FIG. 9 shows a perspective view of the present invention in store.

As illustrated in FIGS. 8 and 9, the cleaning sweeper of the present invention is provided with the storage box 50, by means of which the cleaning sweeper can be kept securely. The storage box 50 comprises a main body 51 and a cover 511. The main body 51 is provided with a receiving compartment 52 having therein a plurality of ribs 55 and is further provided in the edge of the outer side thereof with a recess 54 having a width greater than the width of the handle 40 or the width of the grip 401. Similarly, the cover 511 is provided with a recess 54 corresponding in size and location to the recess 54 of the main body 51. Located respectively at both ends of the recess 54 of the main body 51 is a retaining eye 53 engageable with a retaining block 56 of the cover 511. In other words, the cover 511 and the main body 51 can be held together securely by means of retaining eyes 53 and retaining blocks 56. The cleaning sweeper of the present invention is held in the storage box 50 such that the paper cutter 30, which is mounted in the cutter receiving space 52, the paper roll 10 and the reel support frame 20 are contained in the receiving compartment 52 of the main body 51, and that the paper roll 10 is rested on the ribs 55, and further that the grip 401 is extended to the outside of the storage box 50 via the recess 54.

The cleaning sweeper of the present invention has inherent advantages in that it is provided with a cutting means to facilitate the removing of the soiled portion of the adhesive paper roll so as to enhance the cleaning effect of the cleaning sweeper, and that it is provided with means enabling the cleaning sweeper to be laid on the floor or hung on the wall without causing the adhesive surface of the paper roll to make contact with the floor or wall, and further that it is provided with a storage means to facilitate the safekeeping of the cleaning sweeper.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A cleaning sweeper having an adhesive roller comprising:

an adhesive paper roll mounted on a reel;

a reel support frame of a U-shaped construction and comprising an elongated crown portion having a first end, a second end, and a coupling portion located between said first end and said second end, said reel support frame further comprising a first leg portion extending from said first end of said crown portion and a second leg portion extending from said second end of said crown portion, said first leg portion having a free end which is provided with a protective block fastened thereto, said second leg portion having a free end which is provided with a protective block fastened thereto, said reel being fastened pivotally at both ends thereof with said protective block of said first leg portion and with said protective block of said second leg portion, said reel support frame provided with a baffle located between said crown portion and said reel such that a receiving space is formed between said crown portion and said baffle, with said baffle being U-shaped in construction and comprising an elongated crown portion having a first end and a second end, said baffle further comprising a first leg portion extending from said first end of said crown portion of said baffle and a second leg portion extending from said second end of said crown portion of said baffle, with said first leg portion and said second leg portion of said baffle being provided respectively with a retaining hole and a locating hole;

a dual-directional paper cutter of a U-shaped construction and comprising an elongated crown portion having a cutting edge, a first end and a second end, said paper cutter further comprising a first leg portion extending from said first end of said crown portion of said cutter and a second leg portion extending from said second end of said crown portion of said cutter, with said first leg portion and said second leg portion of said paper cutter being provided respectively with a protuberance and a locating projection, said paper cutter fastened pivotally with said baffle such that said cutting edge of said paper cutter faces said adhesive paper roll; and a handle attached with said reel support frame by said coupling portion.

2. The cleaning sweeper as defined in claim 1, wherein said retaining hole of said baffle is engageable with said protuberance of said paper cutter; and wherein said locating hole of said baffle is engageable with said locating projection of said paper cutter.

3. The cleaning sweeper as defined in claim 1, wherein said protective block of said first leg portion of said reel support frame and said protective block of said second leg portion of said reel support frame are provided respectively with a pivoting block engageable pivotally with said reel.

4. The cleaning sweeper as defined in claim 3, wherein said retaining hole is located closer than said pivoting bloc to said crown portion of said reel support frame.

5. The cleaning sweeper as defined in claim 1, wherein said protective block is provided with a stopping edge on which said paper cutter is rested.

6. The cleaning sweeper as defined in claim 1, further comprising a storage box made up of a main body and a cover, said main body having therein a receiving compartment provided on a bottom surface thereof with a plurality of ribs, said receiving compartment dimensioned to receive therein said adhesive paper roll, said reel support frame and said paper cutter, said main body and said cover provided respectively and correspondingly with a recess dimensioned to permit said handle to extend therethrough when said adhesive paper roll, said reel support frame and said paper cutter are kept in said receiving compartment of said main body of said storage box.

* * * * *